United States Patent [19]

Becraft

[11] Patent Number: 5,066,385

[45] Date of Patent: Nov. 19, 1991

[54] MANUFACTURE OF ISOTROPIC COKE

[75] Inventor: Lloyd G. Becraft, Ponca City, Okla.

[73] Assignee: Conoco Inc., Ponca City, Okla.

[21] Appl. No.: 489,425

[22] Filed: Mar. 5, 1990

[51] Int. Cl.[5] ..... C10G 31/00

[52] U.S. Cl. ..... 208/131; 208/106; 423/450; 423/448

[58] Field of Search ..... 208/50, 106, 126, 131; 423/450, 448

[56] References Cited

U.S. PATENT DOCUMENTS

| | | | |
|---|---|---|---|
| 2,922,755 | 1/1960 | Hackley | 208/39 |
| 3,112,181 | 11/1963 | Petersen et al. | 208/50 |
| 3,759,822 | 9/1973 | Folkins | 208/131 |
| 3,956,101 | 5/1976 | Hara et al. | 208/50 |
| 3,960,704 | 6/1976 | Kegler et al. | 208/50 |
| 4,111,794 | 9/1978 | Pietzka et al. | 208/131 |
| 4,130,475 | 12/1978 | Cameron et al. | 208/131 |
| 4,235,703 | 11/1980 | Kegler et al. | 208/131 |
| 4,312,742 | 1/1982 | Hayashi | 208/50 |
| 4,624,775 | 11/1986 | Dickinson | 208/131 |
| 4,758,329 | 9/1988 | Newman et al. | 208/131 |
| 4,822,479 | 4/1989 | Fu et al. | 208/131 |
| 4,832,823 | 5/1989 | Goyal et al. | 208/131 |

*Primary Examiner*—Anthony McFarlane
*Assistant Examiner*—Nhat Phan

[57] ABSTRACT

Petroleum residual oil which has been contacted with an oxygen-containing gas to increase its softening point is combined with a pyrolysis tar and the combination is subjected to delayed coking to produce isotropic coke containing reduced sulfur and having a low CTE ratio.

8 Claims, 1 Drawing Sheet

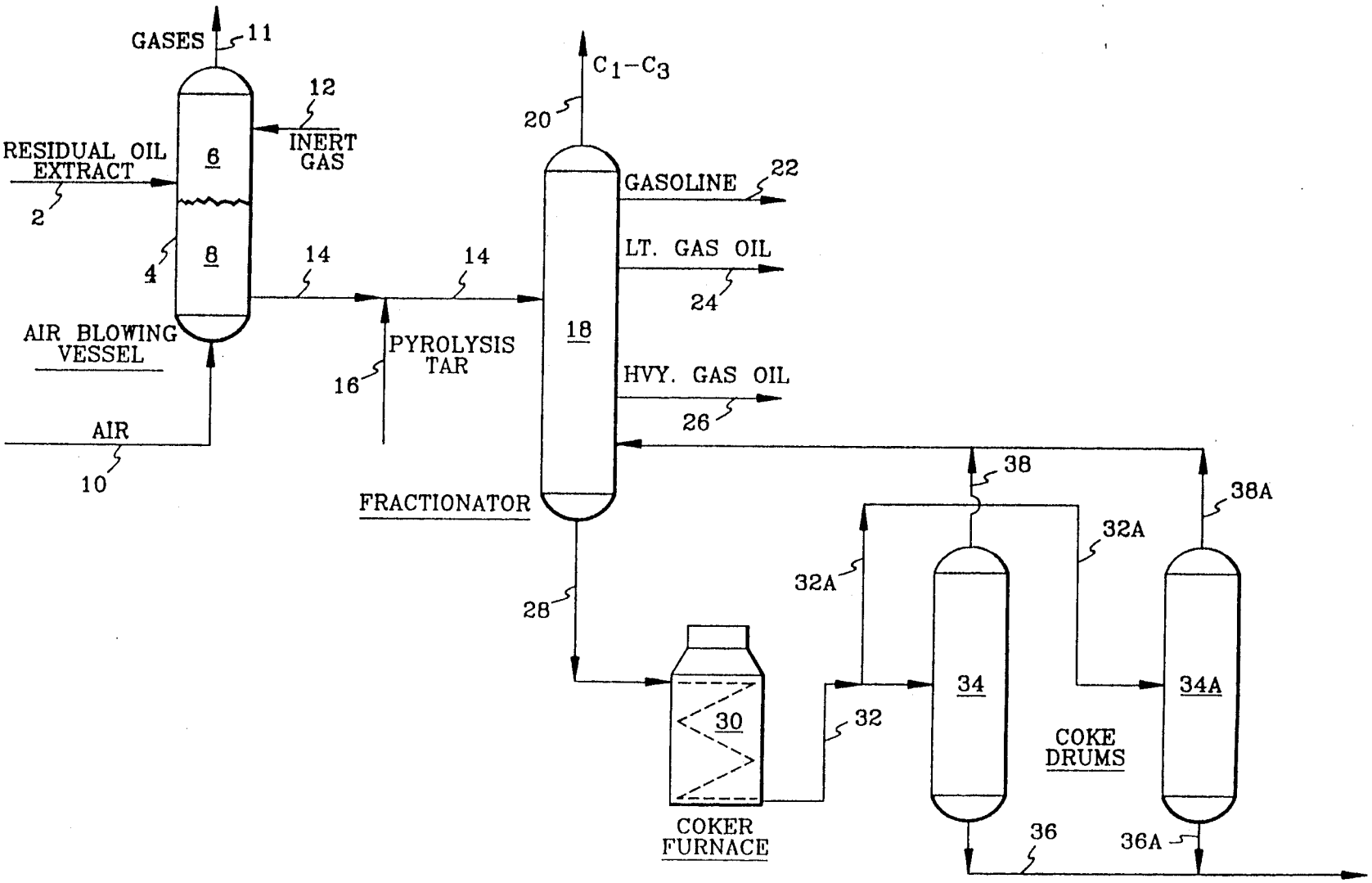
GASES
11
12
INERT GAS
6
8
4
RESIDUAL OIL EXTRACT
2
AIR BLOWING VESSEL
AIR
10
14
14
PYROLYSIS TAR
16
FRACTIONATOR
18
20
$C_1-C_3$
GASOLINE
22
LT. GAS OIL
24
HVY. GAS OIL
26
28
COKER FURNACE
30
32
32A
32A
34
34A
COKE DRUMS
36
36A
38
38A

MANUFACTURE OF ISOTROPIC COKE

BACKGROUND

Isotropic coke has a thermal expansion approximately equal along the three major crystalline axes. This thermal expansion is normally expressed as CTE (i.e coefficient of thermal expansion) over a given temperature range such as 30°-530° C. or 30°-100° C. Isotropic coke is also indicated by a CTE ratio, which is the ratio of radial CTE divided by axial CTE measured on a graphitized extruded rod. Acceptable isotropic coke has a CTE ratio of less than about 1.5 or a CTE ratio in the range of about 1.0-1.5.

Isotropic coke is used to produce hexagonal graphite logs which serve as moderators in high temperature gas-cooled nuclear reactors This type of coke has been produced in the past from natural products such as gilsonite The production of such graphite logs from gilsonite and the use thereof are described in U.S. Pat. Nos. such as 3,231,521 to Sturges; U.S. Pat. No. 3,245,880 to Martin et al; and U.S. Pat. No. 3,321,375 to Martin et al. U.S. Pat. No 3,112,181 to Peterson et al describes the production of isotropic coke using petroleum distillates. Contaminants such as boron, vanadium, and sulfur have prohibited the use of some materials as the source of isotropic coke suitable for use in nuclear reactors Less than about 1.6 weight percent sulfur is preferred to avoid puffing problems upon graphitization and fabrication of the coke. The supply of isotropic coke has been limited by availability of source materials, such as gilsonite and expensive patroleum distillates.

U.S. Pat. No. 3,960,704 describes a process in which a residuum, such as bottoms from the fractionation of virgin feedstocks, is air-blown to increase its softening point. The air-blown resid is then subjected to delayed coking to produce isotropic coke having a CTE ratio less than 1.5.

Residual oils vary substantially in their sulfur content, from less than 1.0 wt % to as high as 4.5 wt % or higher. When residual oils are subjected to coking the amount of sulfur in the resultant coke is from about 1.3 to about 1.5 times as much as the sulfur in the residual oil feedstock. Since it is desirable to obtain an isotropic coke product containing a minimum amount of sulfur, low-sulfur air-blown residual oils are preferred as coker feedstocks; but these oils are limited in supply and are more expensive than higher sulfur feeds.

SUMMARY OF INVENTION

In accordance with this invention a sulfur-containing residual oil, which has been contacted with an oxygen-containing gas at an elevated temperature to increase its softening point, is combined with a pyrolysis tar having a lower sulfur content and the combined material is subjected to delayed coking to provide an isotropic coke product having a low CTE ratio and reduced sulfur content.

PRIOR ART

U.S. Pat. No. 3,960,704 to Kegler et al discloses the production of isotropic coke by air-blowing a petroleum residual oil and thereafter subjecting the air-blown oil to delayed coking. The coke is subsequently processed to obtain graphite logs for use as moderators in high temperature, gas.cooled nuclear reactors.

U.S. Pat. No. 4,624,775 issued to Eric M. Dickinson describes a process for making a premium coke by delayed coking of a mixture of pyrolysis tar and coal tar distillate.

U.S. Pat. No. 3,759,822 issued to Hillis O. Folkins describes a coking feedstock comprising a mixture of pyrolysis tar and a heavy cracked oil.

U.S. Pat. No. 4,130,475 issued to Daniel F. Cameron et al describes a process for making premium coke from a feedstock comprising a mixture of atmospheric reduced crude petroleum oil and ethylene tar.

U.S. Pat. No. 2,922,755 issued to R. C. Hackley describes a process wherein reduced crude can be mixed with thermal tar to produce a feedstock mixture for producing premium coke by delayed coking.

U.S. Pat. No. 3,112,181 to Peterson et al describes the production of isotropic coke for use in the manufacture of moderators employed in nuclear reactors The coker feedstock used is petroleum distillate which has been oxygen treated.

U.S. Pat. No. 4,111,794 issued to Gerhard Pietzka et al describes a method for producing pitch coke from a mixture of coal tar pitch and pyrolysis oil condensate.

BRIEF DESCRIPTION OF THE DRAWING

The drawing is a schematic diagram of a process unit which illustrates the process of the invention.

DETAILED DESCRIPTION OF THE INVENTION

The pyrolysis tar used in the process of the invention may be any tar produced by high temperature thermal cracking in pyrolysis furnaces to produce low molecular weight olefins. In general, olefins comprising primarily ethylene and lesser amounts of propylene, butene, and isobutylene are produced by the severe cracking of petroleum distillates or residues at temperatures from about 1200 to about 1800° F., preferably from about 1300 to about 1600° F., at pressures from atmospheric to about 15 psig and in the presence of a diluent gas. Typical diluents employed are low boiling hydrocarbons such as methane, ethane, or propane, although steam is preferred and is the most commonly used diluent. Ethane and propane can also sarve as the cracking stock. The products of the cracking operation are predominantly olefinic gases such as ethylene, propylene, and butene. A heavy pyrolysis tar is obtained from this cracking operation and is removed with the effluent and separated by condensation.

Pyrolysis tars obtained in this manner are characterized by having low sulfur contents, usually from less than 0.1 wt % to about 2 wt %. These tars also provide high yields of coke when subjected to conventional delayed coking.

Residual oils which can be used to produce the isotropic coke with the process of this invention are those which have not been subjected to extensive thermal or catalytic cracking; for example preferred feedstocks are atmospheric or vacuum reduced crudes. Small amounts of other residual components such as extract residuum, thermal tar, decant oils, and other residua or blends thereof can also be used in the feedstocks of this invention. The sulfur content of these residual oils will vary from less than 1.0 wt % to about 4.5 wt % or higher, which is substantially higher than the sulfur content of the typical pyrolysis tars employed in the process The essential feature of the feedstocks is thought to be their ability to form cross-linked molecules under air-blowing conditions. The preferred feedstocks are those which produce substantial amounts of isotropic coke when subjected to delayed coking after being air-blown.

The amount of pyrolysis tar used in this process will vary depending on the particular residual oil with which it is combined and the amount of sulfur in such residual oil and in the pyrolysis tar. Any amount of pyrolysis tar will provide the desired results, however the use of larger amounts is more effective in reducing the sulfur content of the isotropic coke product. Up to 50 wt % pyrolysis tar or more may be used in the mixture of pyrolysis tar and oxygen-treated residual oil, however the concentration of pyrolysis tar will usually constitute between about 15 and about 40 wt % of the mixture.

The mixture of pyrolysis tar and air-blown resid is converted to isotropic coke by subjecting it to delayed coking. The manufacture of coke by delayed coking refers to the formation of coke in a coke drum, such as described in U.S. Pat. No. 2,922,755 to Hackley. The delayed coking process typically uses petroleum feedstock, such as residuum or a mixture of various petroleum fractions to produce petroleum coke.

Referring now to the drawing, a residual oil is introduced through line 2 to air-blowing vessel 4. Within this vessel there is maintained a body of liquid 8 which is blanketed with inert gas, provided in sufficient quantity to fill the vapor portion 6 of the air-blowing vessel. The inert gas, which may be steam, nitrogen, or other gas which is not reactive in the process is introduced to vapor space 6 through line 12. Air-blown resid is withdrawn from air-blowing vessel 4 through line 14 and gases which include the inert gas, air, and light hydrocarbons are removed overhead from the air-blowing vessel through line 11.

The air-blowing operation is substantially the same as that used for producing asphalt and may be a continuous or batch process. The residual oil charge is heated to a temperature of about 400 to 600° F. which is slightly below its flash point. Air introduced to air-blowing vessel 4 through line 10 is bubbled or blown through the residual oil at a rate of about 20 to about 100 standard cubic feet per minute per ton of residual oil. The residence time of the residual oil in air-blowing vessel 4 is controlled to provide a residual oil product having a softening point of about 120 to about 240° F. and preferably from about 140° F. to about 200° F. While air is the preferred blowing agent because of its availability and cost, other oxygen-containing gases such as oxygen-enriched air may also be used if desired. The residence time required to effect the air-blowing operation will depend on the residual oil which is used. However, the air blowing ordinarily will be completed over a period from about 2 to about 24 hours of residence time.

The hot air-blown residual oil leaving vessel 4 is combined with hot pyrolysis tar provided through line 16. The mixture of residual oil and pyrolysis tar is then introduced to fractionator 18 where it is combined with overhead vapors from coke drums 34 and 34*a*. Light gases $C_1$ to $C_3$ are removed overhead from the fractionator through line 20. Heavier materials such as gasoline and light gas oil are taken from the fractionator through lines 22 and 24 respectively. A mixture of residual oil, pyrolsis tar, and diluent heavy gas oil is removed from the bottom of fractionator 18 through line 28. The purpose of the diluent gas oil is to reduce the viscosity of the mixture and permit easier handling and pumping of the mixture to the delayed coking part of the process. The diluent heavy gas oil which is part of the gaseous effluent from the coke drums does not substantially coke and therefore recycles through the system. The amount of such diluent provided in the residual oil-pyrolysis tar mixture may be controlled by varying the amount of heavy gas oil withdrawn from fractionator 18 through line 26.

The mixture of residual oil, pyrolysis tar and heavy gas oil passes through line 28 and is introduced to coker furnace 30 wherein it is heated to temperatures in the range of 875 to about 975° F. at pressures of about atmospheric to about 250 psig and is then passed via line 32 to coke drums 34 and 34*a*. The coke drums operate on alternate coking and decoking cycles of about 8 to about 100 hours; while one drum is being filled with coke the other drum is being decoked. During the coking cycle each drum operates at a temperature between about 830 and about 950° F. and a pressure from about 15 to about 200 psig.

The overhead vapor from the coke drums is passed via lines 38 or 38*a* to fractionator 18 wherein it is separated into various fractions as previously described. The green coke which is removed from the coke drums through outlets 36 and 36*a* is further processed (not shown) to produce hexagonal graphite logs which are used as moderators in high temperature, gas.cooled nuclear reactors. The manufacture of such rods involves a series of steps which include calcination, heating to remove volatile hydrocarbons, graphitization and densifying treatment. These steps, which do not perform a part of the invention, are described in detail in U.S. Pat. No. 3,112,181 to Peterson et al, which patent is incorporated herein by reference.

As shown in the drawing the residual oil and pyrolysis tar are fed into a fractionator from which a combined mixture of pyrolysis tar, residual oil and heavy gas oil is withdrawn as feed to the delayed coker. This type of operation is typical of a commercial unit. However, the mixture of pyrolysis tar and residual oil can be fed directly to a furnace and thereafter introduced to the coke drums. In the latter operation the diluent, if used, can be heavy gas oil obtained from the coking operation or another suitable diluent material.

The air-blowing operation is shown in the figure as a part of the continuous process. Air-blowing alternatively may be carried out as a batch operation, in which case the air-blown resid would be accumulated in a tank or holding vessel from which it could be introduced continuously to fractionator 18 or to coking furnace 38 as desired. As another alternative a plurality of batch air-blowing vessels could be provided whereby it would be possible to continuously supply air-blown product for further processing without intermediate storage.

The isotropic coke produced by the process of the invention has excellent quality, as indicated by a low CTE ratio, usually less than about 1.5, and by low sulfur content, usually not more than about 1.5 percent. The CTE can be measured by any of several standard methods. For the isotropic coke of this invention, the coke is crushed and pulverized, dried, and calcined to about 2,400° F. This calcined coke is sized so that about 50 percent passes through a No. 200 U.S. standard sieve. The coke is blended with coal tar pitch binder, and a small amount of lubricant. The mixture is extruded at about 1,500 psi into electrodes of about three-fourths-inch diameter and about 5 inches long. These electrodes are heated slowly up to a temperature of about 850° C. and heat-soaked for two hours. After a slow cool-down period (8–10 hours), the baked electrodes are graphitized at approximately 3000° C. Test pieces are machined from the graphitized electrodes. The coefficient of thermal expansion of the test specimens is then measured in the axial and radial directions over the range of about 30–130° C. heated at a rate of about 2° C. per minute. The CTE ratio, as used herein, is the ratio of the radial CTE to axial CTE of the graphitizad electrodes.

When subjected to coking, the pyrolysis tar used in the process of the invention does not produce an isotropic product yet the combination of pyrolysis tar and air-blown residual oil when coked together yields as much as or a higher percentage of isotropic coke product than would be obtained from the air-blown residual oil alone. The process offers a number of advantages over coking only an air-blown residual oil. For example, the isotropic coke product obtained is more marketable because of its lower sulfur content Secondly, less material needs to be air-blown to make a feedstock for an equivalent yield of coke. Also, less desirable (that is, higher sulfur) residual oil can be utilized to prepare isotropic coke of the same sulfur content as would be produced from lower sulfur residual oil without the addition of the pyrolysis tar.

The following example illustrates the results obtained in carrying out the invention:

EXAMPLE

An air-blown residual oil and a low-sulfur pyrolysis tar were blended and the mixture was subjected to dalayed coking. The air-blown residual oil and pyrolysis tar were a also coked separately under the same conditions. The coking conditions used and the results obtained from the coking operations are shown in the following table.

TABLE

| Delayed Coking Conditions: | | | |
|---|---|---|---|
| Temperature, °F. | | | 840 |
| Pressure, psig | | | 60 |
| Run Time, hr | | | 8 |
| Feedstock | Air-Blown Resid | Low-sulfur Pyrolysis Tar | 60 wt %/40 wt % Air-Blown resid/ low-sulfur pyrotar |
| Green Coke Yield, wt % | 28.9 | 45.8 | 34.8 |
| Green Coke Sulfur, wt % | 1.89 | 0.11* | 1.03 |
| CTE of Graphitized Rod | | | |
| Axial, $10^{-7}$/°C. | 48.2 | 11.2 | 41.0 |
| Transverse, $10^{-7}$/°C. | 50.1 | 33.2 | 50.5 |
| CTE Ratio, Transverse/Axial | 1.0 | 3.0 | 1.2 |

*Measured on coke calcined at 2400° F. for 2 hours. At such a low-sulfur content there is little variation in sulfur between green and calcined coke.

The data in the table show that the inclusion of coke derived from pyrolysis tar in the product coke does not greatly affect the CTEs or CTE ratio despite the fact it amounts to roughly half of the coke produced. Thus the coke yield and sulfur content of the product coke can be adjusted by appropriate blending of these feedstock components without substantial deterioration of the isotropy of the product.

While certain embodiments and details have been shown for the purpose of illustrating the present invention, it will be apparent to those skilled in the art that various changes and modifications may be made herein without departing from the spirit and/or scope of the invention.

I claim:

1. A process for producing isotropic coke having reduced sulfur content and a low CTE (coefficient of thermal expansion) ratio from a sulfur-containing residual oil selected from atmospheric and vacuum reduced crudes, which comprises:

(a) contacting the residual oil with an oxygen-containing gas at an elevated temperature to increase the softening point of the residual oil, (b) combining the oxygen-treated residual oil with up to 50 weight percent pyrolysis tar based on the weight of the combined residual oil and pyrolysis tar, said pyrolysis tar having a lower sulfur content than the residual oil, and (c) subjecting the combined residual oil and pyrolysis tar to delayed coking to produce isotropic coke in a yield equal to or greater than the yield obtained from the residual oil alone, said coke having a CTE (coefficient of thermal expansion) ratio less than about 1.5 and a sulfur content lower than the sulfur content of coke obtained from the residual oil alone.

2. The process of claim 1 in which the oxygen-containing gas is air.

3. The process of claim 2 in which the residual oil is reduced virgin crude oil.

4. A process for producing isotropic coke having reduced sulfur content and a low CTE (coefficient of thermal expansion) ratio which consists essentially of (a) combining an air-blown asphalt containing sulfur, obtained from residual oils selected from atmospheric and vacuum reduced crudes, and up to 50 weight percent pyrolysis tar basd on the weight of the combined air-blown asphalt and pyrolysis tar, said pyrolysis tar having a lower sulfur content than the air-blown asphalt, and (b) subjecting the combined material to delayed coking to produce an isotropic coke in a yield equal to or greater than the yield obtained from the air-blown asphalt alone, said coke having a CTE ratio of less than about 1.5 and a sulfur content lower than the sulfur content of the coke obtained from the air-blown asphalt alone.

5. The process of claim 1 in which the weight percent of pyrolysis tar varies between about 15 and about 40 weight percent.

6. The process of claim 4 in which the weight percent of pyrolysis tar varies between about 15 and about 40 weight percent.

7. The process of claim 1 in which the contact of residual oil with the oxygen-containing gas is carried out at a temperature of between about 400° F. and about 600°F. in the presence of sufficient oxygen to increase the softening point of the residual oil to between about 120° F. and about 240°F.

8. The process of claim 7 in which the delayed coking is carried out at a temperature of between about 830° F. and about 950° F., a pressure of between about 15 psig and about 200 psig for about 8 to about 100 hours.

* * * * *